US005265448A

United States Patent [19]

Fontenot

[11] Patent Number: 5,265,448

[45] Date of Patent: Nov. 30, 1993

[54] SECURITY LOCK FOR VAN DOORS

[76] Inventor: Albert M. Fontenot, 11614 Riderwood, Houston, Tex. 77099

[21] Appl. No.: 962,915

[22] Filed: Oct. 19, 1992

[51] Int. Cl.[5] ..... E05C 19/18

[52] U.S. Cl. ..... 70/14; 70/416; 292/288; 16/223

[58] Field of Search ..... 70/14, 32, 1, 57, 58, 70/94, 416–418; 292/288, 302, DIG. 17, 289, 292; 16/82, 86 B, 223, 374

[56] References Cited

U.S. PATENT DOCUMENTS

| | | | |
|---|---|---|---|
| 83,967 | 11/1868 | Howell | 292/288 |
| 314,105 | 3/1885 | Carnes | 16/223 |
| 3,805,325 | 4/1974 | Lee | 16/223 X |
| 3,811,150 | 5/1974 | Chalmers | 292/DIG. 17 X |
| 3,971,100 | 7/1976 | Anop | 292/DIG. 17 X |
| 4,015,868 | 4/1977 | Buttler | 292/302 |
| 4,047,745 | 9/1977 | Krenz | 292/302 |
| 4,819,461 | 4/1989 | Pearson | 70/14 |
| 4,831,688 | 5/1989 | Deininger | 292/288 X |
| 5,044,681 | 9/1991 | Neighbors | 292/288 |
| 5,098,142 | 11/1991 | Fontenot | 292/288 X |

FOREIGN PATENT DOCUMENTS

| | | | |
|---|---|---|---|
| 1107319 | 8/1981 | Canada | 292/288 |
| 329459 | 11/1920 | Fed. Rep. of Germany | 16/223 |
| 1548311 | 12/1968 | France | 16/223 |
| 307609 | 3/1929 | United Kingdom | 292/288 |

*Primary Examiner*—Peter M. Cuomo
*Assistant Examiner*—Suzanne L. Dino
*Attorney, Agent, or Firm*—Bush, Moseley & Riddle

[57] ABSTRACT

In accordance with illustrative embodiments of the present invention, a door lock for a rear door of a van includes a T-shaped member having a leg that is received in the opening between the door hinges, and arms that extend outward from the leg over a portion of the door and the body, respectively. The leg is padlocked against removal from the opening.

6 Claims, 1 Drawing Sheet

FIG. 1
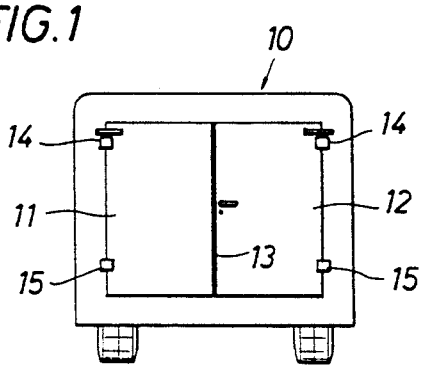
FIG. 4
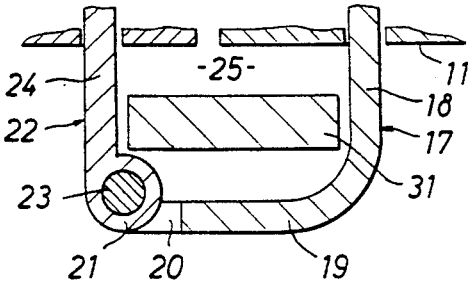
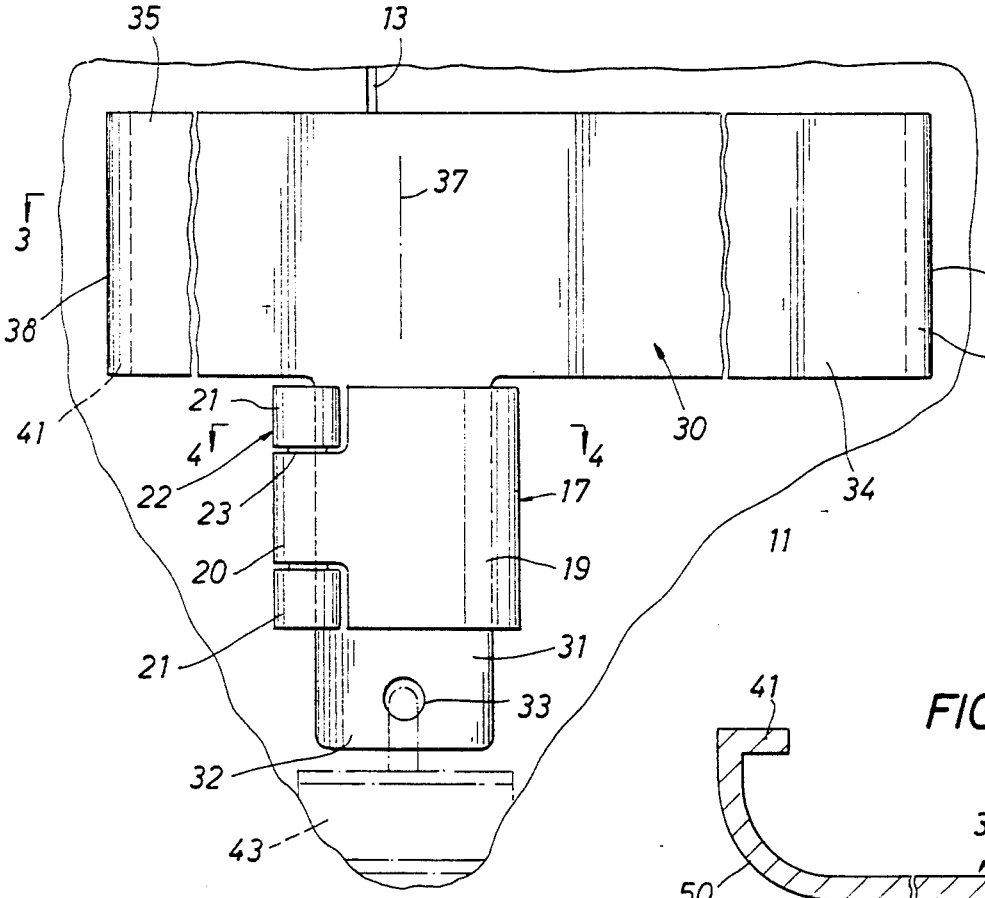
FIG. 2
FIG. 5
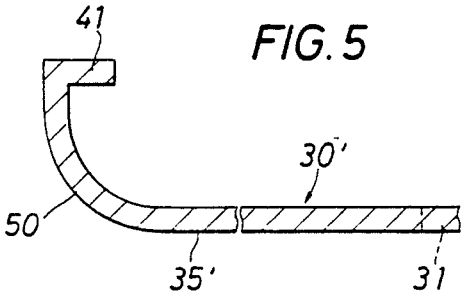
FIG. 3
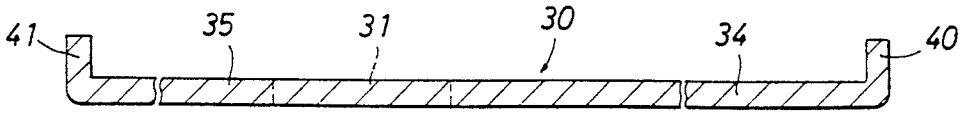

SECURITY LOCK FOR VAN DOORS

FIELD OF THE INVENTION

This invention relates generally to automobile security devices, and particularly to a locking device that cooperates with an automobile door hinge mechanism to prevent the door from being opened unless the lock device is removed.

BACKGROUND OF THE INVENTION

Automobiles such as vans and suburbans which have a pair of rear doors that open outward from the center are highly susceptible to theft by means of forced entry through such doors. In many cases large and expensive items are carried in the rear area of such autos, and can only be removed through these doors. No matter how well the door locking mechanisms may be designed, it is relatively easy to use a pry bar or the like to force at least one of the doors open and gain access to the rear cargo area.

An object of the present invention is to provide a new and improved lock for preventing opening of the rear doors of a van or the like.

Another object of the present invention is to provide a new and improved lock of the type described which cooperates with the hinges which mount the door and the outer wall surfaces adjacent to the hinges for preventing the opening of the door even though the usual key lock mechanism has been opened or rendered inoperative.

SUMMARY OF THE INVENTION

These and other objects are attained in accordance with the concepts of the present invention through the provision of a generally T-shaped member having a leg and oppositely extending arms at the top of the leg. The typical hinge construction on a van or the like includes an inside hinge member that extends outward of the door and then curves approximately 180° to where one or more short cylindrical elements are provided on the end thereof. The outside hinge member extends outward of the body and has cylinder elements which mesh and align with the cylinder element on the inside hinge member, so that a pin can extend therethrough. The hinge members define an open area adjacent the rear wall of the door, and the leg of the lock member is extended through this area to where the bottom portion of the leg projects below the hinge members. The respective arms of the lock member rest on upper edges of the hinge members and project laterally outward thereof in opposite directions. The outer end of each arm is provided with an inwardly extending projection which causes the leg to be shifted toward the curved wall of the inner hinge member, and a side portion thereof to be closely adjacent the cylinder element and hinge pin. A device such as a padlock has its bright passed through a hole near the bottom of the leg, and prevents removal of the leg from the confined area inside the hinges until the padlock is removed. If an attempt is made to force a rear door open, the arms and the leg of the lock member cooperate with external walls of the door and the body of the van, as well as with the cylinder members, to bar the door from being opened.

A locking member of the present invention can be employed on one hinge of each pair of door hinges, or a locking member can be employed on all four hinges.

With the locking members of the present invention in place and padlocked, the van doors are secure, even though the center lock mechanism is essentially destroyed.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 1 is a schematic view of the back of a van showing lock members in accordance with the present invention in place on the upper hinges;

FIG. 2 is a front elevation of one of the lock members of FIG. 1;

FIGS. 3 and 4 are cross sections on lines 3—3 and 4—4 of FIG. 2; and FIG. 5 is a view similar to FIG. 3, but showing an alternative embodiment of the present invention.

DETAILED DESCRIPTION OF A PREFERRED EMBODIMENT

Referring initially to FIG. 1, an automobile 10 such as a typical van has a pair of oppositely swinging doors 11 and 12 that close in the center 13. The outer side of each door 11 and 12 is hung on upper and lower pairs of hinge assemblies 14 and 15. One member of each hinge assembly is bolted to the door near its outer side wall, and the other member is bolted to the body of the van on an inner side wall of the door opening. As shown in FIG. 4, the inner hinge member 17 which is bolted to the door has an outwardly or rearwardly extending first portion 18, and a second portion 19 that curves 180° toward the outer side of the van 10. A cylindrical tab 20 on the outer end of the member 17 is vertically aligned with companion upper and lower cylindrical tabs on the outer end of the hinge member 22. A hinge pin 23 is inserted through the aligned bores of the tabs 20 and 21. The outer hinge member 22 typically has a flat portion 24 which extends forward to where it is bolted to the inner side wall of the door opening. The hinge members 17 and 22 define an open area or region 25 to the rear of the door that typically is about 2 inches wide and 1 inch deep.

Referring now to FIG. 2, a lock member in accordance with this invention is a generally T-shaped member 30 that preferably is made of about ½ inch thick steel plate in order to have high strength against bending. The member 30 includes a leg 31 that is about 2 inches wide and about 3–4 inches long. The bottom portion 32 of the leg 31 is provided with an opening 33 for a purpose to be explained below. The member 30 has oppositely extending arms 34, 35, the arm 34 being about 8 inches long between its outer end surface 36 and the vertical center line 37 of the leg 31, and the opposite arm 35 being about 4 inches long between its outer end surface 38 and such centerline. This arrangement offsets the centerline 37 of the leg 31 toward the outer end of the arm 35.

As shown in FIG. 3, the outer end of each arm 34, 35 is provided with a forwardly extending projection 40, 41 which can be about 1 inch long. When the leg 31 of the lock member 30 is positioned in the open area 25 defined by the hinge members 17 and 22, the proximity of the projections 40, 41 to the outward wall surface of the door and the outer wall of the van body, respectively, cause the leg 31 of the lock member to be positioned outward in the open area 25 as shown in FIG. 4. Such position allows the padlock 43 shown in phantom lines in FIG. 2 to be easily locked through the hole 33, and places the outer side portion of the leg 31 closely adjacent the cylinder members 20 and 21.

An alternative embodiment of the present invention is shown in FIG. 5. All portions of the lock member 30' are the same as described above, except that the arm 35' which extends outward of the leg 31 is made longer and has a curved section 50 which conforms generally to the curvature of the adjacent corner wall of the van 10. The projection 41 thus extends transversely to a point of near engagement with a rear side wall of the van 10.

OPERATION

A lock member 30 is used either at one of the upper or lower hinge assemblies 14 or 15 on each side, or at all four hinge assemblies, as desired. To position a lock member 34, its leg 31 is dropped through the open area 25 of a hinge assembly, and a padlock 43 is secured to the hole 33. The dimensions of the padlock are such that it cannot be shifted upward through the open area 25, and thus locks the member 30 against removal. As noted above, the projections 40, 41 on the ends of the respective arms 34, 35 are of a length such that when their end walls are spaced only slightly away from the adjacent wall surfaces of the door or body, the leg 31 is shifted outward in the area 25 to where its side portion is adjacent the cylindrical members 20, 24 of the higher assembly. In the embodiment shown in FIG. 5, the outer arm 35 curves around to the side of the main corner wall.

If a thief destroys the rear door lock and attempts to open the doors, the lock member 30 or 30' bars all but the slightest opening movement. Outward force on the inner projection 40 is opposed by a reactive force on the opposite projection 41 which bears against an outer wall surface on the van 10. The outer side portion of the leg 31 bears against inner wall surfaces of the pin cylinders 20, 21 of the hinges 18 and 22 to bar the door closed. The padlock prevents the leg 31 from being moved upward and dislodged from the area 25. Thus the door cannot be opened unless the lock member 30 and/or one of the hinge members 17 or 22, or the bolted attachments, are destroyed. The curved outer arm 34' of the embodiment shown in FIG. 5 functions to almost completely bar the door against any opening movement. Thus the lock members 30 and 30' of the present invention provide high security against theft from the rear cargo area of a van.

It now will be recognized that a new and improved security lock for the doors of a van or the like has been disclosed. Since certain changes or modifications may be made in the disclosed embodiment without departing from the inventive concepts involved, it is the aim of the appended claims to cover all such changes and modifications falling within the true spirit and scope of the present invention.

What is claimed is:

1. A door lock for use in substantially preventing the opening of a rear door of a van or the like that is hinged to the van body, comprising: a pair of hinge members defining and surrounding a generally rectangular open area which has an outer corner; cylinder and pin means at said corner for pivotally connecting said hinge members to one another; a generally T-shaped member having a leg and oppositely extending arms at one end of said leg, each of said arms having an outer end, said leg being positioned through said open area so that one of said arms extends inward over a portion of the door and the other of said arms extends outward over a portion of the body; means on said outer ends of each of said arms for causing said leg to engage said cylinder means in response to opening movement of said door to thereby prevent such opening; said leg having means at the other end thereof for receiving a locking device which prevents removal of said leg from said open area.

2. The door lock of claim 1 wherein said causing means includes inwardly extending projection means on said outer end of each of said arms.

3. The door lock of claim 1 wherein said one arm is longer than said other arm.

4. The door lock of claim 2 wherein said projection means are inwardly bent portions at the outer ends of each of said arms.

5. The door lock of claim 1 wherein said receiving means is an aperture that is adapted to receive the bight of a padlock.

6. The door lock of claim 1 wherein said other arm has a forwardly curved outer end portion.

* * * * *